US007270307B2

(12) United States Patent
Zodnik

(10) Patent No.: US 7,270,307 B2
(45) Date of Patent: Sep. 18, 2007

(54) LADDER ACCESSORY ASSEMBLY

(76) Inventor: Richard Zodnik, 31152 Calle Entradero, San Juan Capistrano, CA (US) 92675

( * ) Notice: Subject to any disclaimer, the term of this patent is extended or adjusted under 35 U.S.C. 154(b) by 121 days.

(21) Appl. No.: 11/091,964

(22) Filed: Mar. 28, 2005

(65) Prior Publication Data

US 2005/0247838 A1 Nov. 10, 2005

Related U.S. Application Data

(60) Provisional application No. 60/556,964, filed on Mar. 26, 2004.

(51) Int. Cl.
*E04G 3/20* (2006.01)

(52) U.S. Cl. ..... 248/238

(58) Field of Classification Search ..... 182/129, 182/119; 248/210, 211, 238, 500
See application file for complete search history.

(56) References Cited

U.S. PATENT DOCUMENTS 4,862,994 A * 9/1989 Hughes, Sr. ..... 182/122
5,259,525 A * 11/1993 Wion ..... 220/737
5,503,245 A * 4/1996 Etesam ..... 182/129
6,502,664 B1 * 1/2003 Peaker, Sr. ..... 182/129

FOREIGN PATENT DOCUMENTS

GB 2193523 * 2/1988 ..... 182/28

* cited by examiner

*Primary Examiner*—Ramon O Ramirez
(74) *Attorney, Agent, or Firm*—Ben J. Yorks; Irell & Manella LLP

(57) ABSTRACT

A ladder accessory assembly that can be attached to a ladder. The assembly includes a platform that can be attached to the ladder by a fastener assembly. The platform is of a size that can create or extend the effective shelf space of the ladder. The platform may have mounting features that allow tool accessories such as paint cans, paint trays, etc. to be mounted to a working surface of the platform. The tool accessories are mounted in a way that inhibits tipping of the accessories.

27 Claims, 4 Drawing Sheets

FIG. 2
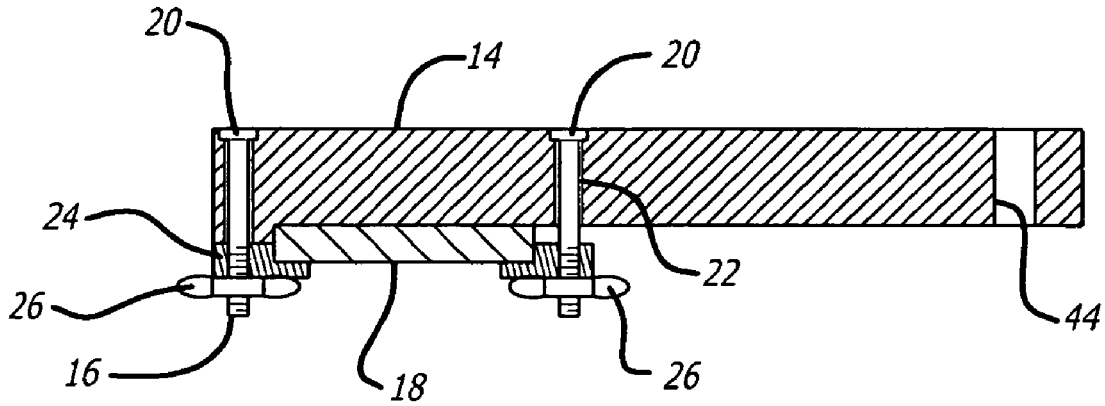
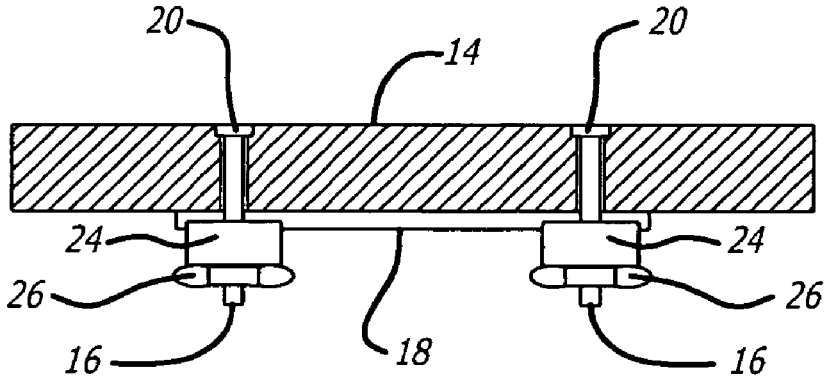
FIG. 3

LADDER ACCESSORY ASSEMBLY

REFERENCE TO CROSS-RELATED APPLICATION

This application claims priority to Application No. 60/556,964 filed on Mar. 26, 2004.

BACKGROUND OF THE INVENTION

1. Field of the Invention

The subject matter disclosed generally relates to the field of ladders.

2. Background Information

Ladders have been used as a working aid to reach inaccessible locations. Commercially available ladders include "A" frame ladders that can be unfolded into a triangular position. "A" frame ladders typically have a small shelf at the top to hold paint cans, etc. Unfortunately, the working surface is typically too small to hold much more that just a paint pan. For example, it can be difficult to balance a paint pan and paint rollers on top of the ladder shelf. Some A-frame ladders include an additional shelf that can be rotated to an unfolded position. Such shelves are typically located at a position below the top of the ladders. It can be difficult to reach objects on the fold-out shelves. Additionally, paint pans and other objects are not secured to the shelves and can easily tip over.

The market also includes extension ladders. Extension ladders do not typically have a shelf that a user can utilize to hold objects such as paint cans. It would be desirable to provide an accessory that can increase the shelf space of the ladder. It would also be desirable to provide a ladder accessory that can secure objects such as paint trays, paint cans, etc.

BRIEF SUMMARY OF THE INVENTION

A ladder accessory assembly that can be attached to a ladder. The assembly includes a fastener assembly that can attach a platform to a ladder. The assembly further has a tool accessory that can be mounted to the platform.

BRIEF DESCRIPTION OF THE DRAWINGS

FIG. 2 is a side sectional view of the assembly;

FIG. 3 is a front sectional view of the assembly;

DETAILED DESCRIPTION

Disclosed is a ladder accessory assembly that can be attached to a ladder. The assembly includes a platform that can be attached to the ladder by a fastener assembly. The platform is of a size that can create or extend the effective shelf space of the ladder. The platform may have mounting features that allow tool accessories such as paint cans, paint trays, etc. to be mounted to a working surface of the platform. The tool accessories are mounted in a way that inhibits tipping of the accessories.

Figure 1:
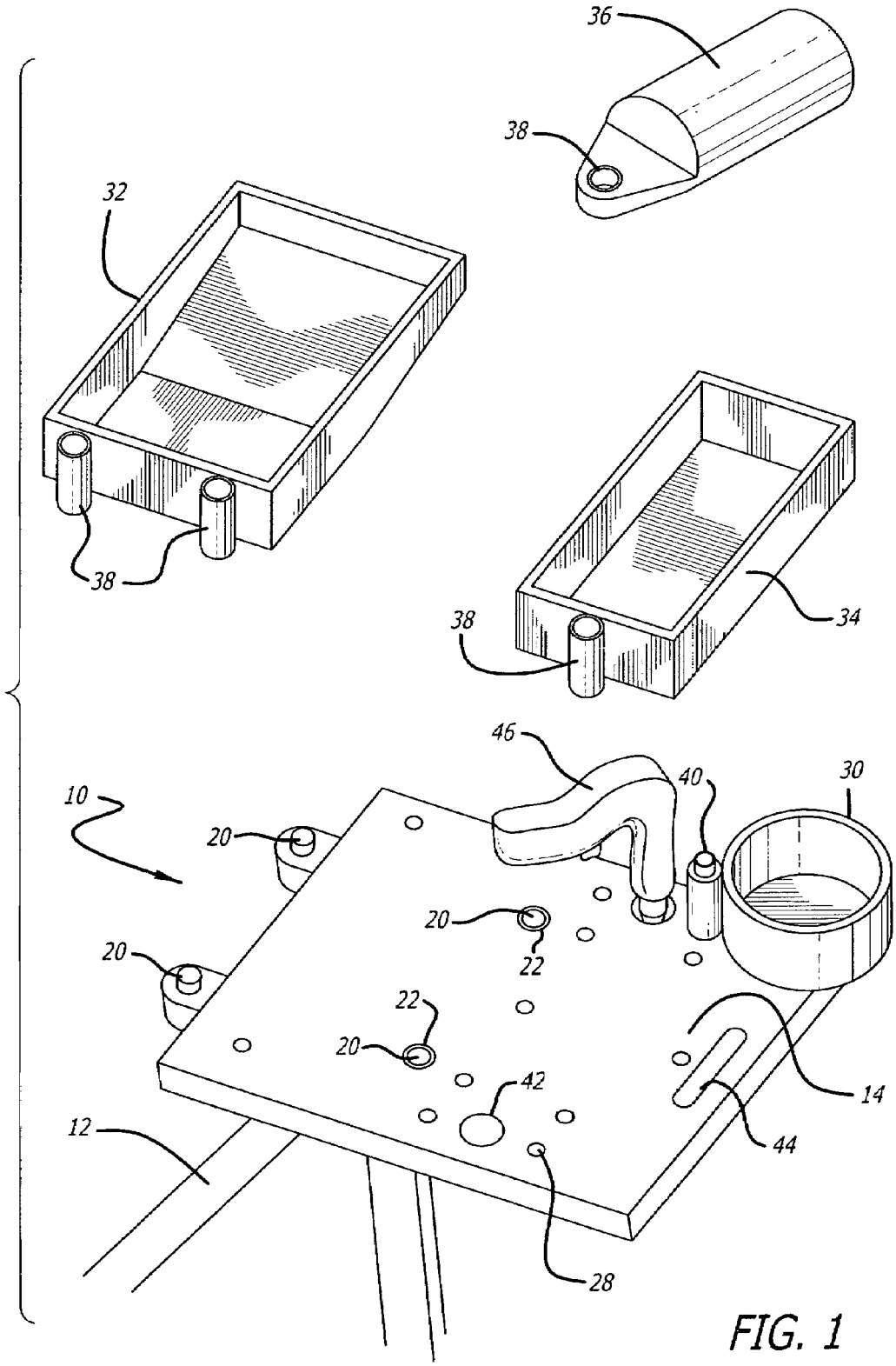
FIG. 1 is a perspective view of a ladder accessory assembly attached to a ladder.

Referring to the drawings more particularly by reference numbers, FIGS. 1, 2 and 3 show an assembly 10 that can be attached to a ladder 12. The assembly 10 includes a platform 14 that can be attached to the ladder 12 by a fastener assembly 16. The platform 14 is preferably much larger than the existing top shelf of the ladder 12. By way of example, the platform 14 may be approximately 22 inches by 20 inches. The large shelf space can simultaneously hold various items such as paint cans, paint pans and tools. The platform 14 is preferably constructed from a molded plastic material to minimize the cost of producing the assembly. The platform 14 may include ribs (not shown) that increase structural integrity without adding significant weight.

The fastener assembly 16 may attach the platform 14 to the top shelf 18 of the ladder 12. The additional shelving space provided by the platform 14 is closer to the user than existing fold-out shelves of the prior art. Therefore, items placed on the platform 14 are more accessible to the user.

The fastener assembly 16 may include a plurality of bolts 20 that extend through clearance holes 22 of the platform 14. The clearance holes 22 may have counterbores so that the bolt bends do not extend past the top surface. The fastener assembly 16 may further include brackets 24, and wing nuts 26 that can thread onto the bolts 20 and press the brackets 24 into the ladder 12.

The platform 14 may have a plurality of mounting apertures 28. The mounting apertures 28 may be used to mount tool accessories 30, 32, 34 and 36 onto the platform 14. By way of example, the tool accessories may be shaped as a paint can 30, paint pan 32 and tool box 34 or a swaybar 36. Each accessory 30, 32, 34 and 36 may have one or more openings 38 that can be aligned with the mounting apertures 28. The openings 38 and apertures 28 may be constructed to accept a standard PVC pipe 40 that is used to secure the accessories 30, 32, 34, and 36 to the platform 14. The platform 14 may have additional holes 42 and a slot 44 that can be used to capture objects such as a standard electrical drill 46. Although mounting apertures 28 are shown, it is to be understood that the platform 14 may have studs (not shown) that extend into the openings 38 of the accessories 30, 32, 34 and 36.

Figure 4:
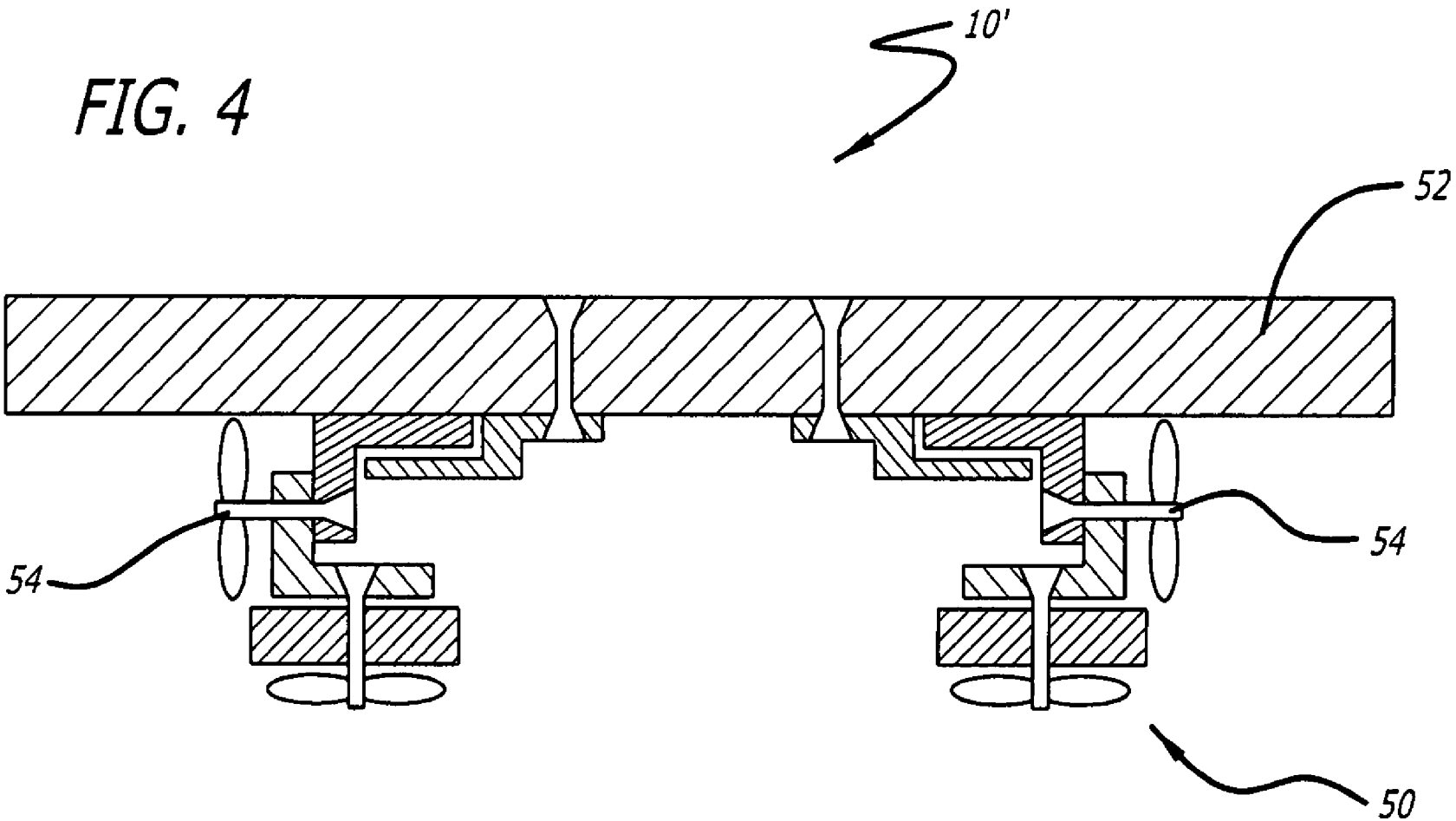
FIG. 4 is a side view of an alternate embodiment of the ladder accessory assembly.
Figure 5:
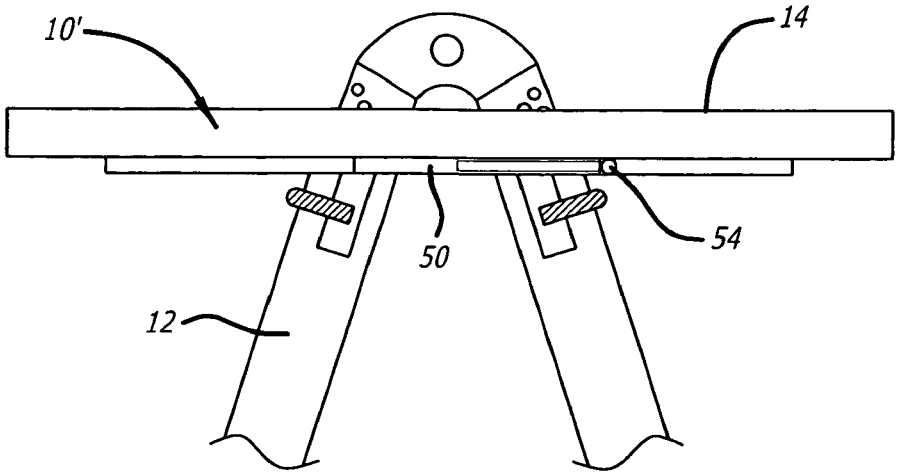
FIG. 5 is a side view of the embodiment shown in FIG. 4 attached to a ladder.
Figure 6:
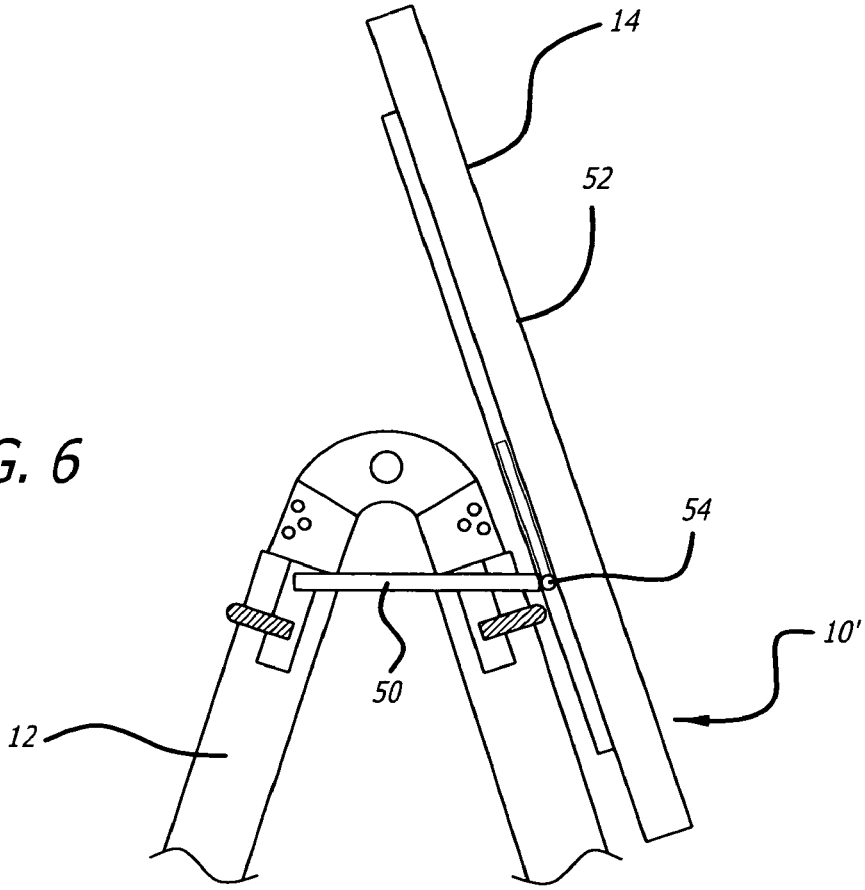
FIG. 6 is a view similar to FIG. 5 showing a platform of the embodiment rotated about a hinge.

FIGS. 4, 5 and 6 show another embodiment of an assembly 10' with a hinge feature. The assembly 10' may include a fastener assembly 50 that can be attached to the ladder 12. The fastener assembly 50 may include bolts, brackets and wing nuts that are the same or similar to the fastener assembly shown in FIGS. 1, 2 and 3. The assembly 10' can be attached to extension or hinge ladders known in the art. The assembly 10' includes a platform 52 coupled to the fastener assembly 50 by a hinge 54. The hinge 54 allows the platform 52 to be rotated to a folded position. The folded position reduces the profile of the ladder accessory assembly 10' so that the ladder 12 and assembly 10' can be more readily stored. The hinge 54 may be a bolt/wing nut assembly that can be turned to fasten the platform 52 in any position. The bolt can be removed to allow the platform 52 to be separated from the fastener assembly 52.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A ladder accessory assembly that can be attached to a ladder that has a top adjoining at least two legs, comprising:

a platform that has a working surface with at least one mounting aperture;

a fastener assembly that couples said platform to the ladder;

a tool accessory that is mounted to said mounting aperture; and, a pipe that extends into said mounting aperture and mounts said tool accessory to said platform.

2. The assembly of claim 1, wherein said tool accessory includes a paint pan.

3. The assembly of claim 1, wherein said tool accessory includes a paint can.

4. The assembly of claim 1, wherein said tool accessory includes a tool holder.

5. The assembly of claim 1, wherein said fastener assembly includes a plurality of brackets, and a plurality of bolts and nuts that can be used to clamp, said brackets to the ladder.

6. The assembly of claim 5, wherein said bolts extend through a plurality of clearance holes in said platform.

7. The assembly of claim 1, further comprising a hinge that couples to said platform to said fastener assembly.

8. The assembly of claim 1, wherein said platform has an opening that can capture a drill.

9. A ladder accessory assembly that can be attached to a ladder that has a top adjoining at least two legs, comprising:

a tool accessory;

a platform that has a working surface with mounting means for mounting said tool accessory to said platform;

fastener means for coupling said platform to the ladder; and, a pipe that extends into said mounting aperture and mounts said tool accessory to said platform.

10. The assembly of claim 9, wherein said tool accessory includes a paint pan.

11. The assembly of claim 9, wherein said tool accessory includes a paint can.

12. The assembly of claim 9, wherein said tool accessory includes a tool holder.

13. The assembly of claim 9, wherein said fastener means includes a plurality of brackets, and a plurality of bolts and nuts that can be used to clamp said brackets to the ladder.

14. The assembly of claim 13, wherein said bolts extend through a plurality of clearance holes in said platform.

15. The assembly of claim 9, further comprising hinge means that allows said platform to pivot relative to said fastener means.

16. The assembly of claim 9, wherein said platform has an opening that can capture a drill.

17. A method for attaching a ladder accessory assembly to a ladder that has a top adjoining at least two legs, and mounting a tool accessory to a platform comprising:

fastening a platform to the ladder; and, mounting a tool accessory to the platform by inserting a pipe into a mounting aperture of the platform.

18. The method of claim 17, wherein the platform is rotated about a hinge.

19. The method of claim 17, wherein the platform is fastened to the ladder with a plurality of brackets, and a plurality of bolts and nuts that clamp the brackets to the ladder.

20. A ladder accessory assembly that can be attached to a ladder that has a top adjoining at least two legs, comprising:

a platform that has a working surface with at least one mounting aperture;

a fastener assembly that couples said platform to the ladder;

a tool accessory that is mounted to said mounting aperture;

a plurality of brackets coupled to said platform;

a plurality of bolts and nuts that can be used to clamp said brackets to the ladder; and, a pipe that extends into said mounting aperture and mounts said tool accessory to said platform.

21. The assembly of claim 20, wherein said tool accessory includes a paint pan.

22. The assembly of claim 20, wherein said tool accessory includes a paint can.

23. The assembly of claim 20, wherein said tool accessory includes a tool holder.

24. The assembly of claim 20, further comprising a hinge that couples to said platform to said fastener assembly.

25. The assembly of claim 20, wherein said platform has an opening that can capture a drill.

26. A method for attaching a ladder accessory assembly to a ladder that has a top adjoining at least two legs, and mounting a tool accessory to a platform comprising:

fastening a platform to the ladder with a plurality of brackets, bolts and nuts; and, mounting a tool accessory to the platform by inserting a piece of pipe into a mounting aperture of the platform.

27. The method of claim 26, wherein the platform is rotated about a hinge.

* * * * *